United States Patent [19]

Bynum

[11] Patent Number: 4,683,416

[45] Date of Patent: Jul. 28, 1987

[54] VOLTAGE REGULATOR

[75] Inventor: Byron G. Bynum, Tempe, Ariz.

[73] Assignee: Motorola, Inc., Schaumburg, Ill.

[21] Appl. No.: 915,483

[22] Filed: Oct. 6, 1986

[51] Int. Cl.[4] ..... G05F 3/16

[52] U.S. Cl. ..... 323/314; 323/907; 307/310

[58] Field of Search ..... 323/313, 314, 315, 316, 323/907; 307/296 R, 297, 310

[56] References Cited

U.S. PATENT DOCUMENTS

| | | | |
|---|---|---|---|
| 4,350,904 | 9/1982 | Cordell | 323/315 X |
| 4,398,160 | 8/1983 | Neidorff | 323/316 X |
| 4,525,682 | 6/1985 | Lai et al. | 323/315 X |
| 4,607,174 | 8/1986 | Shoji et al. | 307/310 X |

*Primary Examiner*—Peter S. Wong
*Assistant Examiner*—Kristine Peckman
*Attorney, Agent, or Firm*—Michael D. Bingham

[57] ABSTRACT

A voltage supply circuit for supplying a regulated output voltage the magnitude and temperature coefficient of which can be independently controlled. A pair of transistors and associated circuitry develop a voltage proportional to the $\Delta V_{BE}$ of the two transistors which are operated at different current densities and sets a first current through the collector of a third transistor which is proportional to $\Delta V_{BE}$ having a positive temperature coefficient (TC). A second current proportional to the negative temperature coefficient base-to-emitter voltage of the third transistor is generated and combined with the first current to produce a third current having a net negative, zero or positive TC. The third current is used to develop a voltage which is combined with the base-to-emitter voltage of the third transistor to produce the output voltage.

17 Claims, 2 Drawing Figures

VOLTAGE REGULATOR

BACKGROUND OF THE INVENTION

This invention relates to regulated voltage supply circuits and, more particularly, to an integrated circuit (IC) voltage regulator capable of producing a direct current voltage the magnitude and temperature coefficient of which can be set to predetermined values.

Prior art voltage regulators commonly include a pair of transistors operated at different current densities. The two transistors are interconnected with associated circuitry so as to develop a voltage therebetween that is proportional to the difference in the respective base-to-emitter voltages ($\Delta V_{be}$). This difference voltage is used to set the current in the emitter of one of the transistors and has a positive temperature coefficient (TC). The thermal emitter current is utilized to produce a voltage that varies directly with absolute temperature which, in turn, is combined with a negative TC voltage to produce a combined voltage having a substantially zero TC.

Although such prior art regulators have significant advantages most, if not all, suffer from serious limitations. For instance, to prevent errors in the thermal current that may be caused by differences in the collector-to-emitter voltages of the two transistors, prior art regulators require complex feedback schemes to inhibit mismatch of the two devices. These schemes are not desirable in the design of integrated circuits as undue chip area is required. Additionally, the voltage level and temperature coefficient of the output regulated voltage of these prior art regulators can not be independently set but rather are determined by the magnitude of the difference voltage $\Delta V_{BE}$. Moreover, prior art regulators can not generate adjustable TC regulated voltages less than the value of a transistor $V_{BE}$ voltage.

Hence, a need exists for a regulator circuit that does not suffer from the aforementioned limitations of the prior art regulators and which does not require complex feedback circuitry to provide an output voltage that can be set to any voltage and temperature coefficient.

SUMMARY OF THE INVENTION

Accordingly, it is an object of the present invention to provide an improved voltage regulator.

It is another object of the present invention to provide an improved integrated voltage regulator circuit which provides an output voltage that can be set to a predetermined voltage level and temperature coefficient.

Still another object of the present invention is to provide a voltage regulator that includes a thermal current source for supplying a current having an adjustable temperature coefficient.

In accordance with the above and other objects there is provided a voltage regulator that includes a thermal current source comprising first and second transistors operated at different current densities, a third transistor having its collector-emitter conduction path connected in series between the emitter of the second transistor and a circuit node which is responsive to feedback current for sinking current from the second transistor to produce a difference voltage between the first and second transistors having a positive TC wherein the voltage difference is utilized to set the collector current through the third transistor, and circuitry connected between the base and emitter of the third transistor for developing a current at the circuit node having a controllable magnitude and a negative TC; and a resistive circuit connected to the circuit node to develop a voltage thereacross that is proportional to the sum of the currents sourced thereto.

DETAILED DESCRIPTION OF THE PREFERRED EMBODIMENTS

Figure 1:
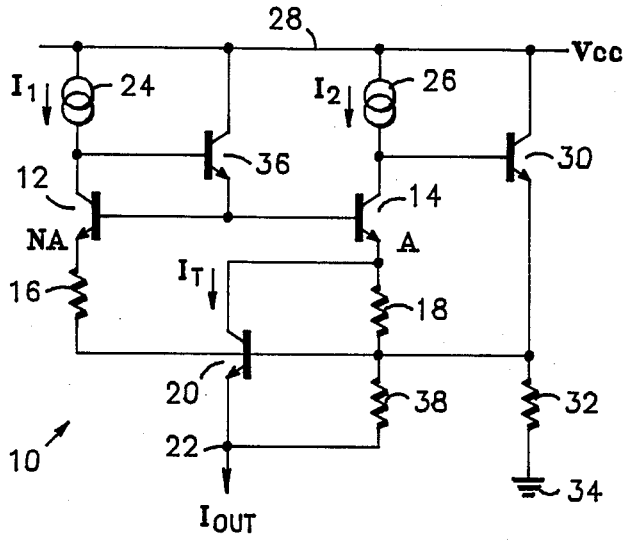
FIG. 1 is a schematic diagram of a thermal current source utilized in the embodiment of the present invention.

Turning now to the FIG. 1 there is shown novel thermal current source 10 of the present invention which is suited to be manufactured in integrated circuit form and which is utilized in the voltage regulator of the preferred embodiment. As will be more fully explained below, current source 10 provides an output current having a predetermined magnitude and temperature coefficient which is controllable. It is understood that corresponding components described in relation to the Figures are designated by the same reference numerals. FIG. 1 illustrates the basic components and interconnection of thermal current source 10.

Thermal current source 10 includes a pair of NPN transistors 12 and 14 the emitters of which are coupled via respective resistors 16 and 18 to the base of NPN transistor 20. The collector-emitter path of transistor 20 is coupled between the emitter of transistor 14 and output node 22 to which is provided an output current $I_{out}$. A pair of current sources 24 and 26 supply currents $I_1$ and $I_2$ to the collectors of transistors 12 and 14 respectively and are connected to power supply conductor 28 to which a positive operating voltage $V_{cc}$ is supplied. Feedback as well as base current buffering is provided by NPN transistor 30 to the base of transistor 20. Transistor 30 has its base coupled to the collector of transistor 14 and its collector-emitter path coupled between conductor 28, the base of transistor 20, and in series with resistor 32 to negative supply conductor 34. A second NPN buffer transistor 36 provides base current drive to the bases of transistors 12 and 14 while buffering the base current effects thereof as understood. Hence, the base-emitter path of transistor 36 is connected between the collector of transistor 12 and the respective bases of transistors 12 and 14 with the collector of the former being coupled to conductor 28. It is understood that the collector of transistor 12 can be directly connected to its base thereby eliminating transistor 36. Resistor 38 is connected between the base and emitter of transistor 20 to supply current to output node 22.

The concept of the present invention consists of (1) developing a difference voltage having a positive temperature coefficient (TC), (2) utilizing the difference voltage to set the current that flows in the collector of transistor 20 wherein the collector/emitter current has a positive temperature coefficient, (3) utilizing the negative TC base-emitter voltage drop, $V_{BE}$, of transistor 20 to develop a current having a negative TC through resistor 38, and (4) summing the two currents at node 22 to produce a combined voltage the value and temperature coefficient of which is controllable.

A difference voltage is produced in the present invention by operating transistors 12 and 14 at different current densities, which as understood, generates a positive TC difference voltage, $\Delta V_{BE}$, therebetween that is proportional to the difference in the base-to-emitter voltages of the two transistors. In the subject invention transistor 12 is operated at a lower current density than transistor 14 by making its emitter area N times larger than the emitter area of transistor 14 (where N is a positive number) and, for example, setting $I_1$ equal to $I_2$ as well as making resistors 16 and 18 of equal value. Therefore, the voltage sum developed across the base-emitter junction of transistor 12 and resistor 16 must be equal to the voltage sum developed across the base-emitter junction of transistor 14 and resistor 18. Because transistor 14 has a smaller emitter area than transistor 12 the current flow through the former is initially less than the current flow through the latter. This causes the collector voltage of transistor 14 to rise with respect to transistor 12 which turns on feedback transistor 30. Transistor 30 will then source base current drive to transistor 20 thereby rendering it conductive to sink a current, $I_T$, at its collector from transistor 14 until the current flow through the latter equals the current flow through transistor 12. By forcing the current through transistor 14 to be equal to the current flow through transistor 12 produces the difference voltage $\Delta V_{BE}$ between the emitters thereof. Hence, it can be shown that the collector/emitter current, $I_T$, of transistor 20 is equal to:

$$I_T = \Delta V_{BE}/R18 \quad (1)$$

where:

$\Delta V_{BE} = (KT/q)\ln N$

K = Boltzman's constant

T = Absolute temperature q = electron charge

R18 is the value of resistor 18.

Hence $I_T$ is a thermal current having a magnitude which can be controllably set by the value of R18 and which varies in direct relation to absolute temperature.

Thermal current source 10 is relatively independent to variations in the power supply voltage as the collector-emitter voltages of transistors 12 and 14 are well matched.

Current $I_T$ is summed with the current flowing through resistor 38 at node 22 to produce an output current $I_{out}$. $I_{out}$ is equal to:

$$I_{out} = I_T + V_{BE20}/R38; \text{ and} \quad (2)$$

$$I_{out} = \Delta V_{BE}/R18 + V_{BE20}/R38, \quad (3)$$

where $V_{BE20}$ is the base-to emitter voltage of transistor 20; and

R38 is the value of resistor 38.

Since $\Delta V_{BE}$ has a positive TC and $V_{BE20}$ has a negative TC, selection of the ratio of R18 to R38 can set the TC of $I_{out}$ either positive, negative or even zero. It is understood that $V_{BE}$ of transistor 20 is well controlled as the collector current thereof is known to be $V_{BE}$/R18.

Figure 2:
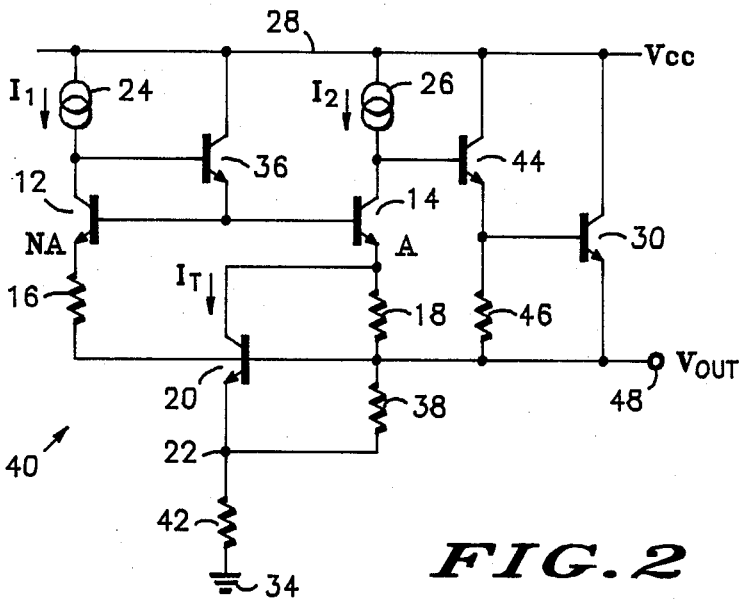
FIG. 2 is a schematic diagram of the voltage regulator of the preferred embodiment.

FIG. 2 illustrates voltage regulator 40 of the present invention which includes thermal current source 10 described above. In the preferred embodiment output node 22 is connected in series with additional resistor 42. An additional NPN buffer transistor 44 is provided which has its base-emitter coupled between the collector of transistor 14 and the base of transistor 30 and its collector coupled to conductor 28 to further buffer the collector of transistor 14 from the effects of load currents sourced at node 48 to a load means connected thereto. Additionally, transistor 44 also ensures that the collector voltage of transistor 14 equals the collector voltage of transistor 12 to prevent mismatch between the two transistors. Resistor 46 is connected between the emitter of transistor 44 and output terminal 48 at which is produced regulated output voltage $V_{out}$.

A voltage is developed across resistor 42 that is proportional to the current $I_{out}$ which is combined with the $V_{BE}$ of transistor 20 to produce combined voltage $V_{out}$. Thus, $V_{out}$ is equal to:

$$V_{out} = V_{BE20}(1 + R42/R38) + \Delta V_{BE} R42/R18 \quad (4)$$

where R42 is the value of resistor 42.

Hence, by proper selection of resistor ratios, $V_{out}$ can be set to any desired voltage and any temperature coefficient independently of one another.

It is understood that although $V_{OUT}$ is taken at output 48 in the preferred embodiment, a regulated output voltage is also produced at node 22 which could be used as an output voltage of the regulator.

In addition, although resistors 16 and 18 have been illustrated as being commonly connected to the base of transistor 20 (FIG. 2), it is apparent from the present disclosure that such connection is not required. In fact, the common connection of resistors 16 and 18 could be tied to any reference potential as long as transistor 14 is prevented from becoming saturated.

Thus, what has been described above is a novel voltage regulator comprising a thermal current source for providing a thermal current having an adjustable temperature coefficient and means for developing a voltage proportional to the thermal current and combining the voltage with another voltage of a different temperature coefficient to produce a combined voltage the magnitude and temperature coefficient of which can be independently controlled.

I claim:

1. A regulated voltage supply, comprising:

first and second transistors arranged with the bases thereof coupled together to conduct respective currents therethrough;

first and second resistors coupled to said first and second transistors respectively with the current flowing through said first transistor also flowing through said first resistor and a portion of the current flowing through said second transistor also flowing through said second resistor;

a third transistor having its collector-emitter conduction path coupled between the emitter of said second transistor and a circuit node;

feedback circuit means coupled between the collector of said second transistor and the base of said third transistor which is responsive to the voltage level at the collector of said second transistor for providing feedback to said third transistor to set the collector current therethrough wherein said first and second transistors are operated at different current densities thereby producing a difference voltage therebetween having a predetermined temperature coefficient (TC) and magnitude, said third transistor conducting the remainder portion of the current from said second transistor and said current flowing through said third transistor having a predetermined magnitude and said temperature coefficient; and means for developing a voltage at said circuit node that is a function of the current sourced to said circuit node, said voltage having a controlled magnitude and TC which is proportional to absolute temperature.

2. The voltage supply of claim 1 wherein said first and second resistors are interconnected to said base of said third transistor.

3. The voltage supply of claim 2 wherein said feedback circuit means includes a fourth transistor having a base coupled to the collector of said second transistor and its collector-emitter conduction path connected between a first power supply conductor and said base of said third transistor.

4. The voltage supply of claim 3 including a third resistor connected between said base and emitter of said third transistor for developing current flow to said circuit node having a controllable magnitude and a temperature coefficient that varies inversely with respect to said temperature coefficient of said current flowing through said third transistor with said voltage appearing at said circuit node having a magnitude and TC that are independently controllable.

5. The voltage supply of claim 4 wherein said circuit means for developing a voltage is a fourth resistor.

6. The voltage supply of claim 5 including an output terminal connected to said base of said third transistor at which is provided an output voltage having a predetermined magnitude and TC which is proportional to the sum of said voltage developed at said circuit node and the base-emitter voltage of said third transistor.

7. The voltage supply of claim 1 wherein said first and second resistors are interconnected at a second circuit node to which is supplied a reference potential.

8. The voltage supply of claim 7 wherein said feedback circuit means includes a fourth transistor having a base coupled to the collector of said second transistor and its collector-emitter conduction path connected between a first power supply conductor and said base of said third transistor.

9. The voltage supply of claim 8 including a third resistor connected between said base and emitter of said third transistor for developing current flow to said circuit node having a controllable magnitude and a temperature coefficient that varies inversely with respect to said temperature coefficient of said current flowing through said third transistor with said voltage appearing at said circuit node having a magnitude and TC that are independently controllable.

10. The voltage supply of claim 9 wherein said circuit means for developing a voltage is a fourth resistor.

11. The voltage supply of claim 10 including an output terminal connected to said base of said third transistor at which is provided an output voltage having a predetermined magnitude and TC which is proportional to the sum of said voltage developed at said circuit node and the base-emitter voltage of said third transistor.

12. An integrated voltage regulator, comprising:

thermal current source means including first and second transistors operated at different current densities to produce a difference voltage therebetween having a predetermined temperature coefficient, a first resistor coupled to the emitter of said second transistor for sinking a portion of the current therefrom, a third transistor having its collector-emitter path coupled between said emitter of said second transistor and a circuit node and feedback circuit means responsive to said second transistor for providing a feedback signal to the base of said third transistor such that the latter sinks current from the emitter of said second transistor of a predetermined magnitude, said current flowing through said third transistor having said predetermined temperature coefficient;

a second resistor coupled between said base and emitter of said third transistor for providing current flow to said circuit node having a predetermined magnitude and temperature coefficient that varies inversely to said temperature coefficient of said current flow through said third transistor; and a third resistor connected to said circuit node through which said currents flowing through said third transistor and said second resistor are summed such that a regulated voltage is developed thereacross the magnitude and temperature coefficient of which can be independently set.

13. The voltage regulator of claim 12 including means for coupling the base of said third transistor to an output of the regulator.

14. The regulator of claim 13 including a fourth resistor interconnected between the emitter of said first transistor and said first resistor with the interconnection therebetween being coupled to said base of said third transistor.

15. The regulator of claim 14 wherein said feedback circuit means includes a fourth transistor having its base coupled to the collector of said second transistor and its collector-emitter path coupled between a first power supply conductor and said base of said third transistor.

16. The regulator of claim 15 including:

current supply means coupled between said first power supply conductor and the collectors of said first and second transistors for providing current thereto; and means for connecting the collector of said first transistor to the base thereof.

17. The regulator of claim 16 wherein the emitter area of said first transistor is N times the emitter area of said second transistor where N is a positive number and said feedback circuit means forces the current conducted by said first and second transistors to be substantially equal.

* * * * *